US010317114B2

(12) United States Patent
Liu et al.

(10) Patent No.: US 10,317,114 B2
(45) Date of Patent: Jun. 11, 2019

(54) METHODS AND SYSTEMS OF STREAMING REFRIGERANT IN A HEAT EXCHANGER

(71) Applicants: TRANE INTERNATIONAL INC., Davidson, NC (US); TRANE AIR CONDITIONING SYSTEMS (CHINA) CO., LTD., Taicang (CN)

(72) Inventors: Bin Liu, Shanghai (CN); Jing Ma, Shanghai (CN); Fei Huang, Shanghai (CN)

(73) Assignees: TRANE INTERNATIONAL INC., Davidson, NC (US); TRAINE AIR CONDITIONING SYSTEMS (CHINA) CO., LTD., Taicang (CN)

( * ) Notice: Subject to any disclaimer, the term of this patent is extended or adjusted under 35 U.S.C. 154(b) by 639 days.

(21) Appl. No.: 14/898,385

(22) PCT Filed: Jun. 13, 2013

(86) PCT No.: PCT/CN2013/077152

§ 371 (c)(1),
(2) Date: Dec. 14, 2015

(87) PCT Pub. No.: WO2014/198031

PCT Pub. Date: Dec. 18, 2014

(65) Prior Publication Data

US 2016/0146518 A1 May 26, 2016

(51) Int. Cl.
*F25B 39/02* (2006.01)
*F28D 3/02* (2006.01)
(Continued)

(52) U.S. Cl.
CPC ..... *F25B 39/02* (2013.01); *F25B 31/004* (2013.01); *F25B 43/02* (2013.01); *F28D 3/02* (2013.01);
(Continued)

(58) Field of Classification Search
CPC ..... F25B 2339/0242; F25B 2339/024; F25B 2339/021; F25B 39/00; F25B 39/02;
(Continued)

(56) References Cited

U.S. PATENT DOCUMENTS 51,275 A * 11/1865 Zimmerman ..... F28D 7/08 165/116
123,465 A * 2/1872 Ellerbrock ..... F28D 7/08 165/116
(Continued)

FOREIGN PATENT DOCUMENTS

CN 1500193 5/2004
CN 101936627 1/2011
(Continued)

OTHER PUBLICATIONS

International Search Report and Written Opinion for International Application No. PCT/CN2013/077152, dated Mar. 20, 2014, 13pgs.

*Primary Examiner* — Orlando E Aviles
(74) *Attorney, Agent, or Firm* — Hamre, Schumann, Mueller & Larson, P.C.

(57) ABSTRACT

Embodiments are disclosed to help create longitudinal refrigerant streams, for example, in a shell and tube type evaporator, so as to manage refrigerant and/or lubricant in the evaporator. In some embodiments, the shell side of the evaporator may include a plurality of longitudinally extended pans stacked in a vertical direction. In some embodiments, refrigerant can be directed onto a top pan. The refrigerant can form a longitudinal refrigerant stream along the pan and flow down to the next pan in the vertical direction and form another longitudinal refrigerant stream. Each of the pans may form a refrigerant pool to help exchange heat with a process fluid carried in heat exchanger tubes. By forming longitudinal refrigerant streams in the pans, heat exchange efficiency may be improved and a
(Continued)

lubricant content in refrigerant streams may be concentrated toward a bottom of the evaporator.

5 Claims, 12 Drawing Sheets

(51) Int. Cl.

| | |
|---|---|
| ***F28D 3/04*** | (2006.01) |
| ***F28D 7/16*** | (2006.01) |
| ***F25B 31/00*** | (2006.01) |
| ***F25B 43/02*** | (2006.01) |
| ***F28D 5/02*** | (2006.01) |
| *F28D 21/00* | (2006.01) |
| *F28F 9/22* | (2006.01) |

(52) U.S. Cl.
CPC ..... *F28D 3/04* (2013.01); *F28D 5/02* (2013.01); *F28D 7/16* (2013.01); *F25B 2339/0242* (2013.01); *F28D 2021/0071* (2013.01); *F28F 2009/226* (2013.01)

(58) Field of Classification Search
CPC . F25B 39/028; F28D 7/16; F28D 3/00; F28D 3/02; F28D 3/04; F28D 5/00; F28D 5/02; F28F 9/13; F28F 2009/224; F28F 2009/226
See application file for complete search history.

(56) References Cited

U.S. PATENT DOCUMENTS

| | | | | |
|---|---|---|---|---|
| 147,149 | A * | 2/1874 | Matthiessen | F28D 7/08 165/116 |
| 320,144 | A * | 6/1885 | Kux | F25B 43/046 165/116 |
| 1,151,938 | A * | 8/1915 | Hardie | F28D 7/08 165/116 |
| 1,848,741 | A | 3/1932 | Nelson | |
| 2,025,990 | A * | 12/1935 | Kokemper | A23L 3/04 165/116 |
| 2,038,002 | A * | 4/1936 | Ris | B01D 1/04 165/116 |
| 2,038,088 | A * | 4/1936 | Sebald | F25B 39/02 165/116 |
| 2,568,984 | A | 9/1951 | Bowsher | |
| 2,577,832 | A | 12/1951 | Weiks | |
| 2,830,797 | A | 4/1958 | Garland | |
| 2,854,828 | A | 10/1958 | Garland | |
| 4,766,737 | A | 8/1988 | Franklin | |
| 4,796,695 | A | 1/1989 | Cannon | |
| 6,481,242 | B2 | 11/2002 | Shirakata et al. | |
| 6,516,627 | B2 | 2/2003 | Ring et al. | |
| 7,707,850 | B2 | 5/2010 | Wang et al. | |
| 2008/0149311 | A1 | 6/2008 | Liu et al. | |

FOREIGN PATENT DOCUMENTS

| | | |
|---|---|---|
| CN | 202452766 | 9/2012 |
| JP | H0278871 | 3/1990 |

* cited by examiner

METHODS AND SYSTEMS OF STREAMING REFRIGERANT IN A HEAT EXCHANGER

FIELD

The disclosure herein relates to heating, ventilation, and air-conditioning ("HVAC") systems, and more particularly to a heat exchanger, such as an evaporator, of the HVAC system. Generally, methods, systems and apparatuses are described that are directed to fluid (such as refrigerant and/or lubricant) management in a heat exchanger (e.g. an evaporator) such as may be used in HVAC chillers.

BACKGROUND

A HVAC system generally includes a compressor, heat exchangers such as a condenser and an evaporator, and an expansion device. Generally, in a cooling mode, the compressor can compress refrigerant vapor. The refrigerant vapor may be directed into the condenser to be condensed into liquid refrigerant. The liquid refrigerant may be directed into the evaporator through the expansion device to become a two-phase refrigerant mixture and reduce its temperature. In the evaporator, the refrigerant can exchange heat with a process fluid, such as water or air.

The heat exchangers can have various types and configurations. In some HVAC systems, such as a chiller, a commonly used heat exchanger is a shell and tube type heat exchanger. The shell and tube type heat exchanger generally has a tubes-inside-a-shell configuration. A shell side and a tube side are generally configured to be in a heat exchange relationship and carry two different fluids. For example, in an evaporator, the shell side can be configured to carry refrigerant and the tube side can be configured to carry the process fluid, such as water. The refrigerant can exchange heat with the process fluid so as to regulate a temperature of the process fluid. For a heat exchanger that works as an evaporator, commonly used shell and tube types of heat exchanger can be a falling film, or flooded evaporator.

SUMMARY

Systems, methods and apparatuses are disclosed to help create longitudinal refrigerant streams, for example, in a shell and tube type evaporator, so as to help manage refrigerant and/or lubricant in the evaporator.

In some embodiments, the evaporator may include a shell side and an inlet configured to direct refrigerant into the shell side. In some embodiments, the evaporator may include one or more longitudinally extended pans stacked on top of each other in a vertical arrangement. In some embodiments, the evaporator may include a first pan extending in a longitudinal direction of the evaporator in the shell side, and the first pan may be configured to collect the refrigerant directed into the shell side by an inlet to form a first refrigerant pool in the first pan, and direct the refrigerant to flow along the first pan. The evaporator may also include a first plurality of longitudinally extended heat exchanger tubes positioned above a bottom of the first pan, and the first refrigerant pool may be configured to exchange heat with at least one of the first plurality of longitudinally extended heat exchanger tubes when the evaporator is in operation.

In some embodiments, the evaporator may include a second pan extending in the longitudinal direction, and the second pan may be positioned below the first pan in the vertical arrangement along a vertical direction defined by a height of the shell. The second pan may be configured to collect the refrigerant flowing out of the first pan to form a second refrigerant pool, and direct the refrigerant to flow along the second pan.

In some embodiments, the evaporator may include a second plurality of longitudinally extended heat exchanger tubes positioned above a bottom of the second pan, and the second refrigerant pool may be configured to exchange heat with at least one of the second plurality of longitudinally extended heat exchanger tubes.

In some embodiments, the inlet of the evaporator may be positioned about a first end of the evaporator so as to direct refrigerant into the first pan at a position that is at about the first end of the evaporator when in operation.

In some embodiments, the inlet may be positioned about a middle portion of the evaporator so as to direct refrigerant into the first pan at about a middle position of the pan.

In some embodiments, an evaporator may include a shell side and an inlet configured to direct refrigerant into the shell side. The evaporator may include a first pan extending in a longitudinal direction of the evaporator and define a pan space. The pan space can be configured to collect the refrigerant directed by the inlet and direct the refrigerant to flow along the first pan in the pan space. The evaporator may include a first plurality of longitudinally extended heat exchanger tubes positioned in the pan space, and at least one of the first plurality of longitudinally extended heat exchanger tubes may be configured to exchange heat with the refrigerant collected in the pan space when in operation.

In some embodiments, a method of managing refrigerant in an evaporator may include directing liquid refrigerant into a shell side of the evaporator, directing the liquid refrigerant in a longitudinal direction of the evaporator to form a first longitudinal refrigerant stream; and forming a refrigerant pool to exchange heat with a heat exchanger tube of the evaporator.

In some embodiments, the method of managing refrigerant in the evaporator may include directing the liquid refrigerant into the shell side of the evaporator at around a middle portion of a top of the evaporator. The refrigerant can be directed toward two ends of the evaporator to form a bidirectional longitudinal refrigerant stream.

In some embodiments, the method of managing refrigerant in the evaporator may include directing the liquid refrigerant into the shell side of the evaporator at around a first end of a top of the evaporator. The refrigerant can be directed from the first end to a second end of the evaporator to form a longitudinal refrigerant stream.

In some embodiments, the method of managing refrigerant in the evaporator may include collecting refrigerant from the first longitudinal refrigerant stream, and directing the first longitudinal refrigerant stream toward a direction that is generally opposite to the direction of the first longitudinal refrigerant stream in the longitudinal direction.

Other features and aspects of the fluid management approaches will become apparent by consideration of the following detailed description and accompanying drawings.

BRIEF DESCRIPTION OF THE DRAWINGS

Reference is now made to the drawings in which like reference numbers represent corresponding parts throughout.

FIG. 2A is a side view. FIG. 2B is an end view.

FIG. 5A is an exploded view of a shell side of the evaporator, with the shell and heat exchanger tubes removed. FIG. 5B is an end view of the evaporator, with the heat exchanger tubes removed. FIG. 5C illustrates an embodiment of a tube sheet. FIG. 5D is an enlarged view of an end section of the shell side as shown in FIG. 5A. FIG. 5E is an enlarged view of a middle section of the shell side as shown in FIG. 5A. FIG. 5F illustrates an exploded view of a refrigerant distributor. FIG. 5G illustrates an enlarged view of an inlet baffle of the refrigerant distributor as illustrated in FIG. 5F.

DETAILED DESCRIPTION

Figure 1:
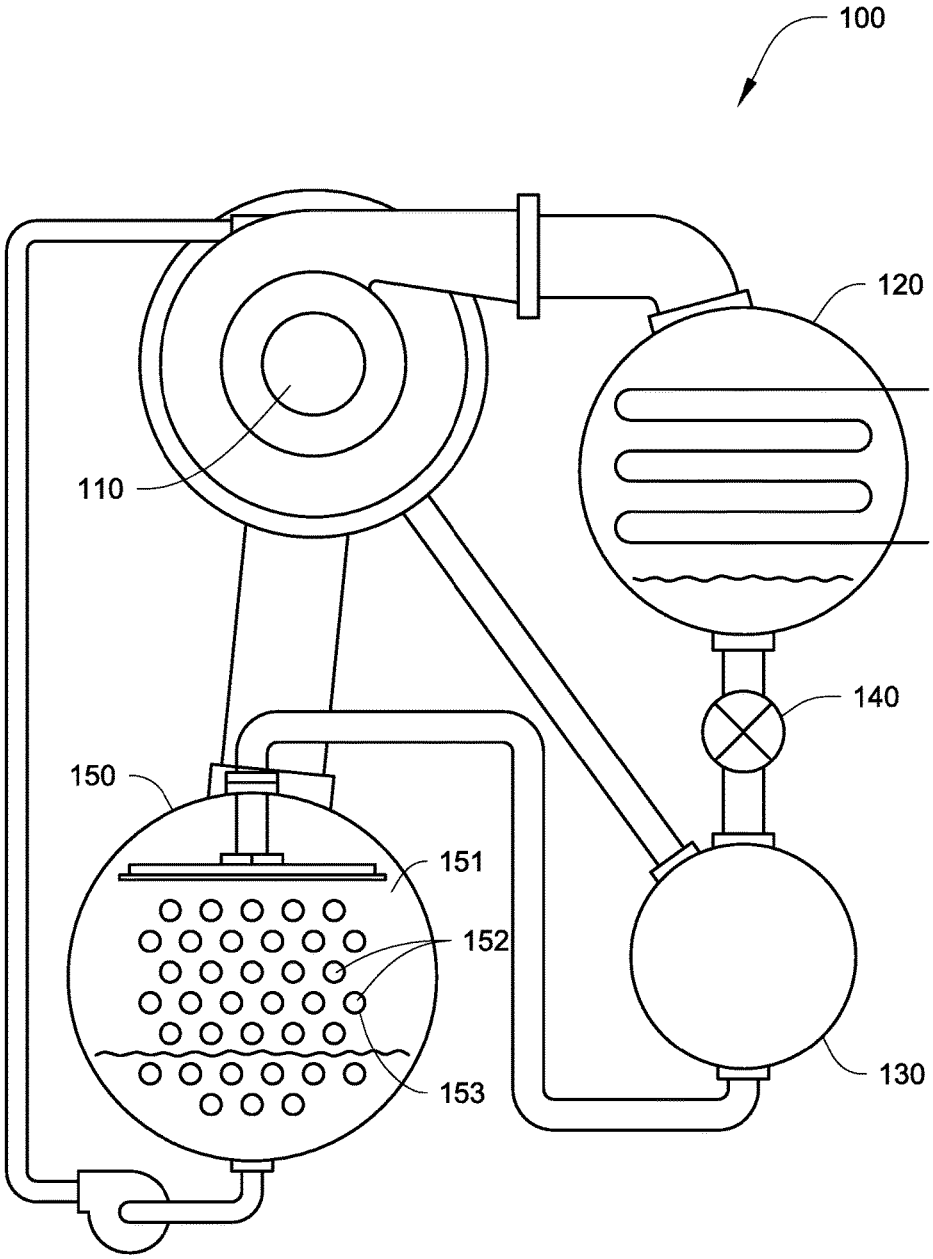
FIG. 1 is a schematic diagram of a HVAC system with shell and tube type of heat exchangers (e.g. an evaporator and a condenser).

Shell and tube types of heat exchangers are often used in a HVAC system, such as may include a chiller. FIG. 1 illustrates a schematic diagram of a chiller 100, which includes a compressor 110, a condenser 120, an economizer 130, an expansion device 140 and an evaporator 150 to form a refrigeration circuit. In the chiller 100, the condenser 120 and the evaporator 150 are shell and tube type of heat exchangers.

The evaporator 150 has a shell side 151 and a tube side 152 that is defined by heat exchanger tubes 153. The shell side 151 is configured to receive, for example, a two-phase refrigerant mixture of liquid and vapor expanded by the expansion device 140. The refrigerant can exchange heat with a process fluid (such as water) flowing through the tube side 152 of the heat exchanger tubes 153.

The compressor 110 generally requires a lubricant. In the chiller 100, the lubricant may be mixed with the refrigerant (i.e. a refrigerant/lubricant mixture) and circulated with the refrigerant in the circuit. Various configurations of the evaporator 150 and/or the condenser 120 have been described to help manage refrigerant and the lubricant in the refrigerant circuit. Improvements can still be made to help manage the refrigerant and the lubricant to, for example, increase efficiency and/or reduce a refrigerant charge of the chiller 100.

Embodiments as disclosed herein are related to systems, methods and apparatuses to create longitudinal refrigerant streams in an evaporator, such as the evaporator 150, of a chiller (e.g. the chiller 100), so as to help manage the refrigerant and/or the lubricant in the chiller. In some embodiments, a shell side of the evaporator may include at least one pan extending in a longitudinal direction. In some embodiments, the shell side of the evaporator may include a plurality of longitudinally extended pans stacked in a vertical arrangement. In some embodiments, an inlet of the evaporator may be configured to direct refrigerant from a top of the evaporator to a top pan in the vertical arrangement. The refrigerant can form a longitudinal refrigerant stream in the pan and flow down to the next pan in the vertical arrangement. The refrigerant can then form a longitudinal refrigerant stream in the next pan in the vertical arrangement. In some embodiments, each of the pans may form a refrigerant pool to exchange heat with fluid flowing through the heat exchanger tubes. By creating longitudinal refrigerant streams in the pans, heat exchange efficiency may be improved and a lubricant content in refrigerant streams may be concentrated toward a bottom of the evaporator.

References are made to the accompanying drawings that form a part hereof, and in which is shown by way of illustration of the embodiments in which the embodiments may be practiced. The term "refrigerant" may refer to a refrigerant/lubricant mixture. It is also to be understood that the term "liquid refrigerant" is generally referred to refrigerant in a liquid state, but the liquid refrigerant may contain some refrigerant in a vapor state. The term "refrigerant vapor" is generally referred to refrigerant in the vapor state, but the refrigerant vapor may contain some refrigerant in a liquid state. It is to be understood that the terms used herein are for the purpose of describing the figures and embodiments and should not be regarded as limitation the scope of the present application.

Figure 2A:
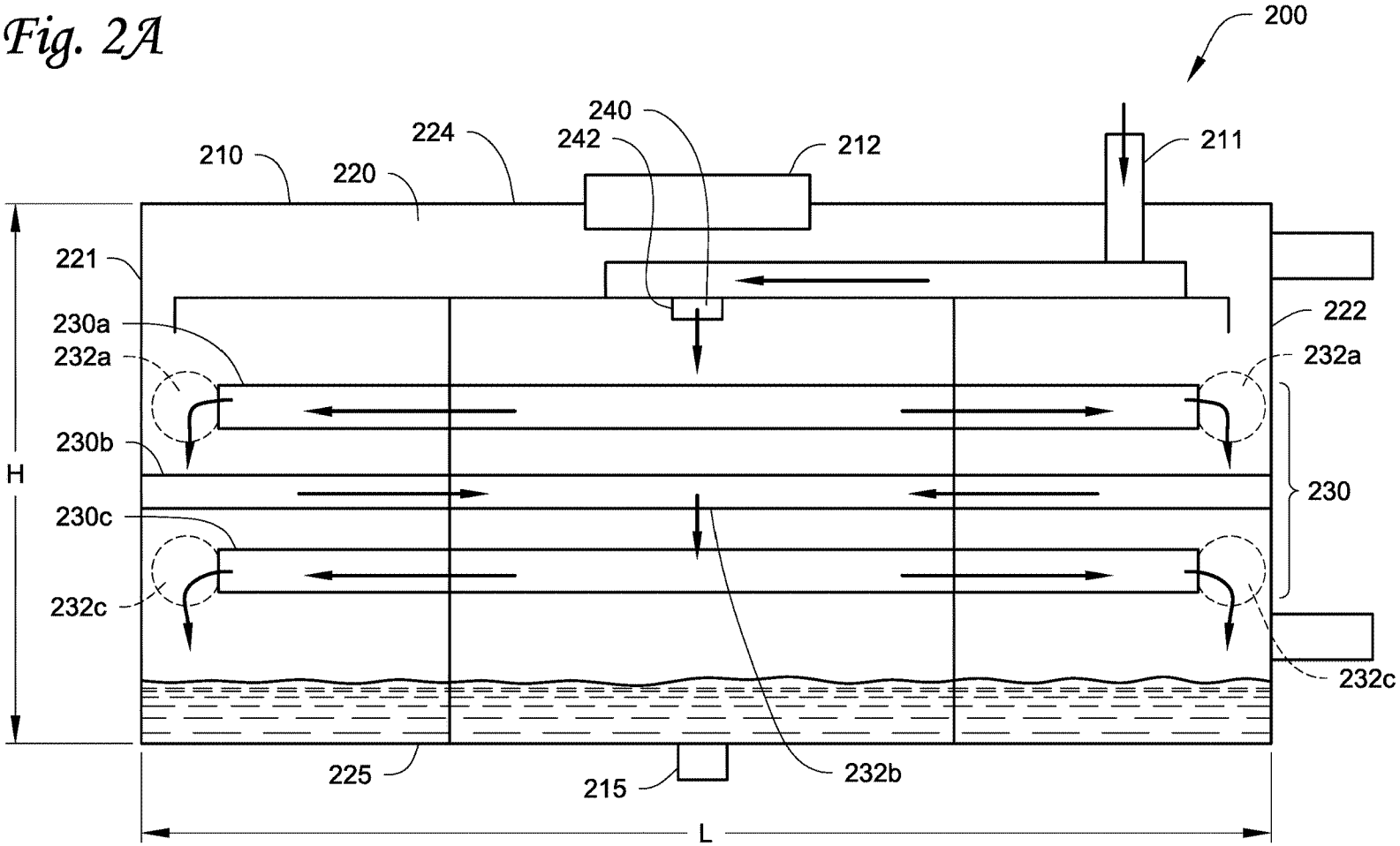
FIGS. 2A and 2B illustrate schematic diagrams of an evaporator configured to create longitudinal refrigerant streams in a shell side of an evaporator, according to one embodiment.
Figure 2B:
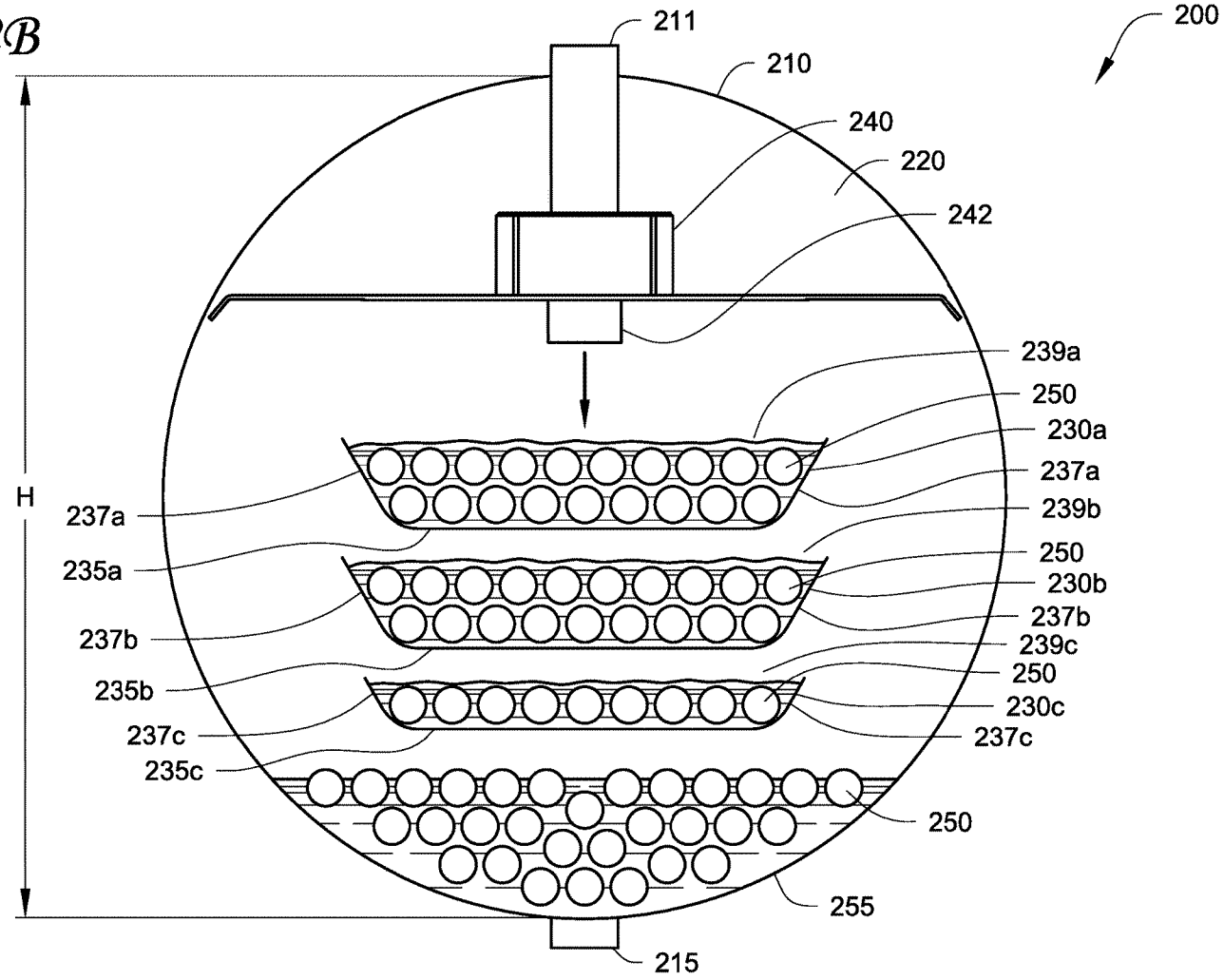

FIGS. 2A and 2B illustrate a side view and an end view of a schematic diagram of a shell and tube type evaporator 200 according to one embodiment. The heat exchanger tubes (heat exchanger tubes 250 in FIG. 2B) are omitted from FIG. 2A for simplicity.

The evaporator 200 includes a shell 210 that defines a shell side 220. The shell 210 equipped with a refrigerant inlet 211 and a refrigerant outlet 212 that are located on a top 224 of the shell 210 relative to a vertical direction that is defined by a height H of the shell 210. The refrigerant inlet 211 is configured to direct refrigerant (generally liquid refrigerant or liquid/vapor refrigerant mixture) into the shell side 220, and the refrigerant outlet 212 is configured to direct refrigerant (generally refrigerant vapor) out of the shell side 220.

The shell side 220 can include a series of pans 230. In the illustrated embodiment in FIGS. 2A and 2B, the series of pans 230, by way of example but without limitation, includes three pans 230*a*, 230*b* and 230*c* stacked in a vertical arrangement along the vertical direction respectively. It is to be understood that the series of pans 230 may include more or less than three pans in other embodiments. In some embodiments, the shell side 220 may include only one pan.

The shell 210 has a length L that defines a longitudinal direction and the height H that defines the vertical direction. The pans 230*a*, 230*b* and 230*c* generally extend in the longitudinal direction and are stacked in the vertical direction respectively. In the longitudinal direction, the top pan 230*a* and the bottom pan 230*c* in the vertical arrangement have spaces 232*a* and 232*c* respectively between ends of the pans 230*a* and 230*c* and the first end 221 and the second end 222 of the shell side 220. The spaces 232*a* and 232*c* are configured to allow refrigerant to flow out of the pans 230*a* and 230*c* through the spaces 232*a* and 232*c* respectively.

The middle pan 230*b* in the vertical arrangement, which is situated between the pans 230*a* and 230*c*, generally extends the full length L of the evaporator 210 and has a refrigerant drainage 232*b* (see an example of a refrigerant drainage 532*b* in FIG. 5A) in a middle region of the pan 230*b* relative to the longitudinal direction. The refrigerant drainage 232*b* is configured to allow refrigerant to flow out the pan 230*b* through the refrigerant drainage 232*b*.

The shell 210 includes a bottom 225 relative to the vertical direction. An oil return port 215 is positioned in a middle region of the bottom 225 relative to the longitudinal direction.

The refrigerant inlet 211 is in fluid communication with a refrigerant distributor 240 that includes an inlet baffle 242.

In the illustrated embodiment, the inlet baffle 242 is positioned in a middle region of the distributor 240 in the longitudinal direction.

It is to be appreciated that the refrigerant drainage 232*b* can be positioned at other positions along the middle pan 230*b* between the first and second ends 221, 222 in the longitudinal direction. The oil return port 215 may be positioned at other locations along the bottom 225 in the longitudinal direction.

FIG. 2B is an end view of the evaporator 200. As illustrated, the pans 230*a*, 230*b* and 230*c* are stacked in the vertical arrangement that is defined by the height H. The shell side 220 includes a plurality of heat exchanger tubes 250. It is understood that the heat exchanger tubes 250 extend in the longitudinal direction that is defined by the length L as illustrated in FIG. 2A.

Each of the pans 230*a*, 230*b* and 230*c* has a bottom 235*a*, 235*b* and 235*c*, and raised walls 237*a*, 237*b* and 237*c* respectively. In the end view as shown in FIG. 2B, the pans 230*a*, 230*b* and 230*c* define a pan space 239*a*, 239*b* and 239*c* (the shaded areas in FIG. 2B). The pan spaces 239*a*, 239*b* and 239*c* are generally the maximum areas or volumes that the pans 230*a*, 230*b* and 230*c* can hold a liquid (assuming the ends of the pans 230*a*, 230*b* and 230*c* are closed) without overflowing the walls 237*a*, 237*b* and 237*c* respectively. The pans 230*a*, 230*b* and 230*c* are configured to contain one or more rows of the heat exchanger tubes 250 in the pan spaces 239*a*, 239*b* and 239*c*. Some of the heat exchanger tubes 250 are positioned just above the bottom 235*a*, 235*b* and/or 235*c*. In some embodiments, the shell side 220 also includes one or more rows of the heat exchanger tubes 250 positioned toward the bottom 225 of the shell 210. In some embodiments, the shell side 220 that is outside of the pan spaces 239*a*, 239*b* and 239*c* and the bottom 225 generally does not have heat exchanger tubes running through.

The number of rows of the heat exchanger tubes 250 in each pan spaces 239*a*, 239*b* and 239*c* as well as toward the bottom 255 can vary. In some embodiments, the rows of the heat exchanger tubes 250 can be at or less than 4-5 rows. Generally, the number of rows of the heat exchanger tubes 250 can be configured based on, for example, a total tonnage or capacity of the evaporator 200. On the other hand, the number of rows of the heat exchanger tubes 250 can be kept at a relatively small number to reduce the refrigerant charge required to submerge the heat exchanger tubes 250.

In some embodiments, the number of rows of the heat exchanger tubes 250 can be configured to keep a velocity of the refrigerant flow in each of the pan spaces 239*a*, 239*b* and 239*c* relatively constant. Accordingly, the pan space(s) relatively close to the top 224 may generally have more rows of heat exchanger tubes than the pan space(s) relatively close to the bottom 225. For example, the pan spaces 239*a* may generally have more rows of heat exchanger tubes 250 than the pan space 239*c*.

Referring to FIGS. 2A and 2B, the operation of the evaporator 200 will be explained in more detail. The arrows inside the evaporator 200 as illustrated in FIGS. 2A and 2B generally indicate refrigerant flow directions.

As illustrated in FIG. 2A, the refrigerant can be directed into the shell side 220 through the refrigerant inlet 211. In the illustrated embodiment, the position of the refrigerant inlet 211 is positioned toward the second end 222 of the shell side 220 in the longitudinal direction defined by the length L. This is exemplary. The refrigerant inlet 211 can be positioned, for example, toward the first end 221 of the shell side 220 or at other locations between the first and second ends 221, 222, such as for example toward a middle region of the shell 210 in the longitudinal direction.

The refrigerant directed into the shell side 220 generally contains liquid refrigerant (e.g. liquid refrigerant in a liquid/vapor refrigerant mixture). After entering the shell side 220 from the inlet 211, the refrigerant can be redirected toward the middle region of the distributor 240 in the longitudinal direction from the inlet 211, where the inlet baffle 242 is located.

The liquid refrigerant can be directed to the top pan 230*a* in the vertical arrangement. The liquid refrigerant can be redistributed longitudinally in the top pan 230*a*. Since the liquid refrigerant is firstly directed to the top pan 230*a* in the middle portion of the top pan 230*a* in the longitudinal direction, the liquid refrigerant can then flow toward both of the first end 221 and the second end 222 of the evaporator 200, forming a bidirectional refrigerant stream in the pan space 239*a*.

The refrigerant stream in the top pan 230*a* can flow to the next pan in the vertical arrangement, the middle pan 230*b*, from the spaces 232*a*. In the middle pan 230*b*, the refrigerant stream is also bi-directional, which flows from the first and second ends 221 and 222 respectively toward the middle portion of the middle pan 230*b*. The middle pan 230*b* typically extends the full length L of the heat exchanger 200 and there is typically no space between the middle pan 230*b* and the first and second ends 221, 222 of the evaporator 200. The refrigerant stream can normally flow out of the middle pan 230*b* from the middle portion of the middle pan 230*b* through the refrigerant drainage 232*b*. The refrigerant stream then is directed to the next pan in the vertical arrangement, the bottom pan 230*c*, through the refrigerant drainage 232*b*. The liquid refrigerant in the pan 232*c* forms a bidirectional refrigerant stream flowing toward the ends 221 and 222 of the shell side 220 from the middle portion of the bottom pan 232*c*. The refrigerant stream then flows toward the bottom 225 of the shell 210 through the spaces 232*c*.

In each of the pans 230*a*, 230*b* and 230*c*, the refrigerant streams are configured to form a refrigerant pool that is sufficient to submerge and/or wet at least some of the heat exchanger tubes 250 in the corresponding pan spaces 239*a*, 239*b* and 239*c* respectively.

The refrigerant streams created in the shell side 220 of the evaporator 200 can help increase heat exchange efficiency between the refrigerant in the shell side 210 and a process fluid carried in the heat exchanger tubes 250.

The refrigerant stream in each of the pans 230*a*, 230*b* and 230*c* can also help lubricant management in the evaporator 200, which is circulated with the refrigerant. In the HVAC system, the refrigerant can contain lubricant. The refrigerant/lubricant mixture may be circulated together in the HVAC system. The refrigerant streams in the shell side 220 can help reduce/prevent lubricant attaching to surfaces of the heat exchanger tubes 250. As the refrigerant stream flows along the pans 230*a*, 230*b* and 230*c* in the vertical arrangement, the refrigerant content continues to be vaporized due to exchanging heat with the heat exchanger tubes 250, and a lubricant content in the refrigerant streams may be concentrated because the liquid refrigerant content decreases. Thus, the evaporator 200 can also help increase a lubricant concentration in the refrigerant streams as the refrigerant flows toward the bottom 225. The lubricant concentration in the refrigerant streams is generally the highest toward the oil return port 215 located at the middle portion of the bottom 225 of the shell 210. The refrigerant with a relatively high lubricant concentration can be directed out of the evaporator 200 from the oil return port 215. Relative to the flow direction of the refrigerant streams in the shell side 220, the oil return port 215 is generally positioned in the middle portion of the bottom 225 of the shell 210 so that the refrigerant stream in the bottom most pan (i.e. the pan 230*c*) in the vertical arrangement generally flows away from the oil return port 215. This may help the refrigerant streams travel a longitudinal distance that is as long as possible in the evaporator 200 before flowing to the oil return port 215, which may help increase the lubricant concentration at the oil return port 215.

In some embodiments, the lubricant concentration at the oil return port 215 may be comparable to a conventional flooded evaporator. In some embodiments, the lubricant concentration at the oil return port 215 is about 4%.

It is to be noted that the embodiment as illustrated in FIGS. 2A and 2B is exemplary. A general method to manage refrigerant and/or lubricant in an evaporator disclosed herein may include directing liquid refrigerant into a shell side of the evaporator and creating one or more longitudinal refrigerant streams in a shell side of an evaporator. The method may also include collecting the refrigerant to form a refrigerant pool to exchange heat with at least some of the heat exchanger tubes of the evaporator. In some embodiments, the plurality of longitudinal refrigerant streams may be arranged in a vertical arrangement of the evaporator, and the plurality of longitudinal refrigerant streams may be configured to have alternating flow directions from a top to the bottom of the evaporator. In some embodiments, the method may include directing refrigerant in a relatively small area at a starting point of the refrigerant stream. As illustrated in FIG. 2A, the starting point of the refrigerant streams may be at about the middle portion of the top pan 230*a*.

In some embodiments, the method of managing refrigerant in the evaporator may include directing the liquid refrigerant into the shell side of the evaporator at around a middle portion of a top of the evaporator. The refrigerant can be directed toward two ends of the evaporator to form a bidirectional longitudinal refrigerant stream.

In some embodiments, the method of managing refrigerant in the evaporator may include directing the liquid refrigerant into the shell side of the evaporator at around a first end of a top of the evaporator. The refrigerant can be directed from a first end to a second end of the evaporator to form a longitudinal refrigerant stream.

In some embodiments, the method of managing refrigerant in the evaporator may include collecting refrigerant from a first refrigerant stream, and then directing the first refrigerant stream toward an opposite direction in the longitudinal direction.

Figure 3:
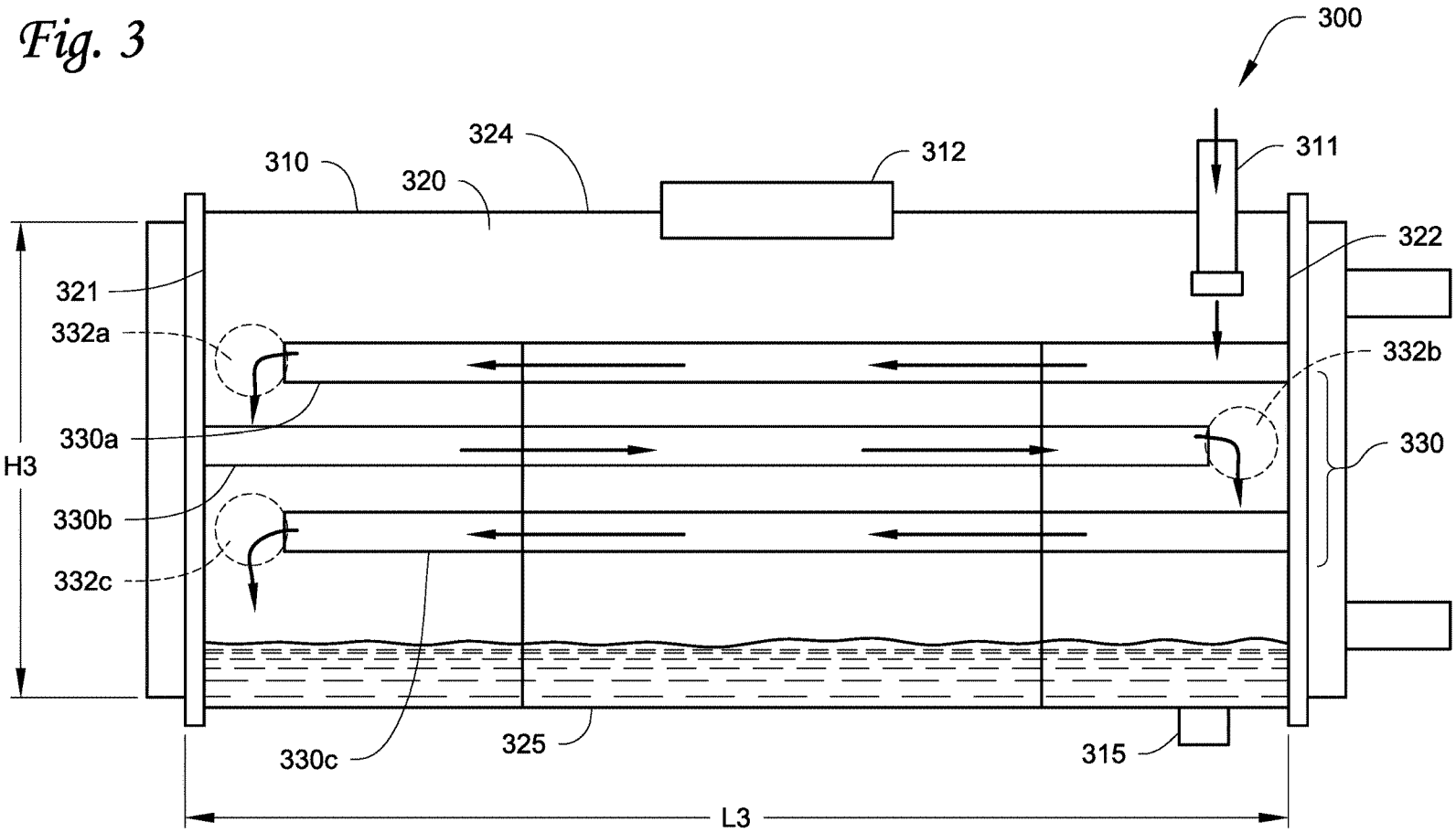
FIG. 3 illustrates a schematic diagram of an evaporator configured to create longitudinal refrigerant streams in a shell side of an evaporator, according to another embodiment.

FIG. 3 illustrates a schematic view of another embodiment that can be configured to perform the general method to manage refrigerant and/or lubricant, which includes creating longitudinal refrigerant streams in an evaporator 300.

The evaporator 300 includes a shell 310 that defines a shell side 320. The shell 310 is equipped with a refrigerant inlet 311 and a refrigerant outlet 312 on a top 324 of the evaporator 300 relative to a vertical direction that is defined by a height H3 of the shell 310. The shell side 320 has a first end 321 and a second end 322. The refrigerant inlet 311 is positioned toward the second end 322.

The shell side 320 includes a series of pans 330 that extends in a longitudinal direction defined by a length L3 of the shell 310. In the illustrated embodiment in FIG. 3, by way of example but without limitation, the series of pans 330 includes three pans 330*a*, 330*b* and 330*c*, which are arranged respectively in a vertical arrangement along the vertical direction defined by the height H3. It is to be understood that the series of pans 330 may include more or less than three pans in other embodiments.

Each of the pans 330*a*, 330*b* and 330*c* has one end attached to the first end 321 or the second end 322, while the other end has a space 332*a*, 332*b* and 332*c* respectively. The pans 330*a*, 330*b* and 330*c* are attached to the first end 321 or the second end 322 alternatively in the vertical arrangement. In the illustrated embodiments, by way of example but without limitation, the top pan 330*a* and the bottom pan 330*c* in the vertical arrangement are attached to the second end 322. The middle pan 330*b* is attached to the first end 321.

The refrigerant inlet 311 is positioned close to the end (e.g. the second end) of the top pan 330*a* that is attached to the second end 322, and is configured to direct liquid refrigerant to the top pan 330*a* in a relatively small area toward the end of the top pan 330*a*.

The liquid refrigerant can be directed in the longitudinal direction along the top pan 330*a* to form a first longitudinal refrigerant stream. The refrigerant stream can flow out of the top pan 330*a* and flow down to the middle pan 330*b* through the space 332*a* and forms a second refrigerant stream in the middle pan 330*b*. Similarly, the liquid refrigerant can subsequently flow to the bottom pan 330*c* and form a third refrigerant stream in the bottom pan 330*c*.

An oil return port 315 is positioned on a bottom 325 of the shell 310, close to the second end 322 of the shell 310. Relative to a flow direction of the refrigerant streams in the shell side 320, the oil return port 315 is generally positioned at a position, from which the refrigerant stream in the bottom most pan (330*c*) flows away in the longitudinal direction.

It is noted that the embodiments as illustrated in FIGS. 2A, 2B and 3 are not meant to be limiting. An evaporator can be configured differently to create the longitudinal refrigerant streams. It is also noted that the number of pans in the vertical arrangement can vary. In the illustrated embodiments, the number of pans is three. This is exemplary and not meant to be limiting. The number of pans in the vertical arrangement is generally at least one. In addition, the number of rows of heat exchanger tubes contained in each of the pan spaces can also vary. In FIG. 2B, the number of rows of heat exchanger tubes is one or two. This is exemplary and not meant to be limiting. The number of rows of heat exchanger tube in each of the pan spaces is generally at least one. In some embodiments, the number of rows of heat exchanger tubes can be 4-5.

In the illustrated embodiments, the pans are generally extended horizontally relative to the vertical arrangement and are parallel from each other. This is exemplary and not meant to be limiting. In some embodiments, the pans may be tilted relative to the vertical direction to, for example, help create the refrigerant streams. The pans may also be tilted toward different directions relative to the vertical direction so that the pans are not generally parallel to each other. In some embodiments, the pans may not be flat. The pans may have a geometry that may help create the longitudinal refrigerant flows in the shell side, such as slopes and ramps. For example, the pan may be configured so that a middle portion of the pan may be higher than the end portions of the pan relative to the vertical direction to facilitate the refrigerant to flow from the middle portion toward the two ends.

Figure 4:
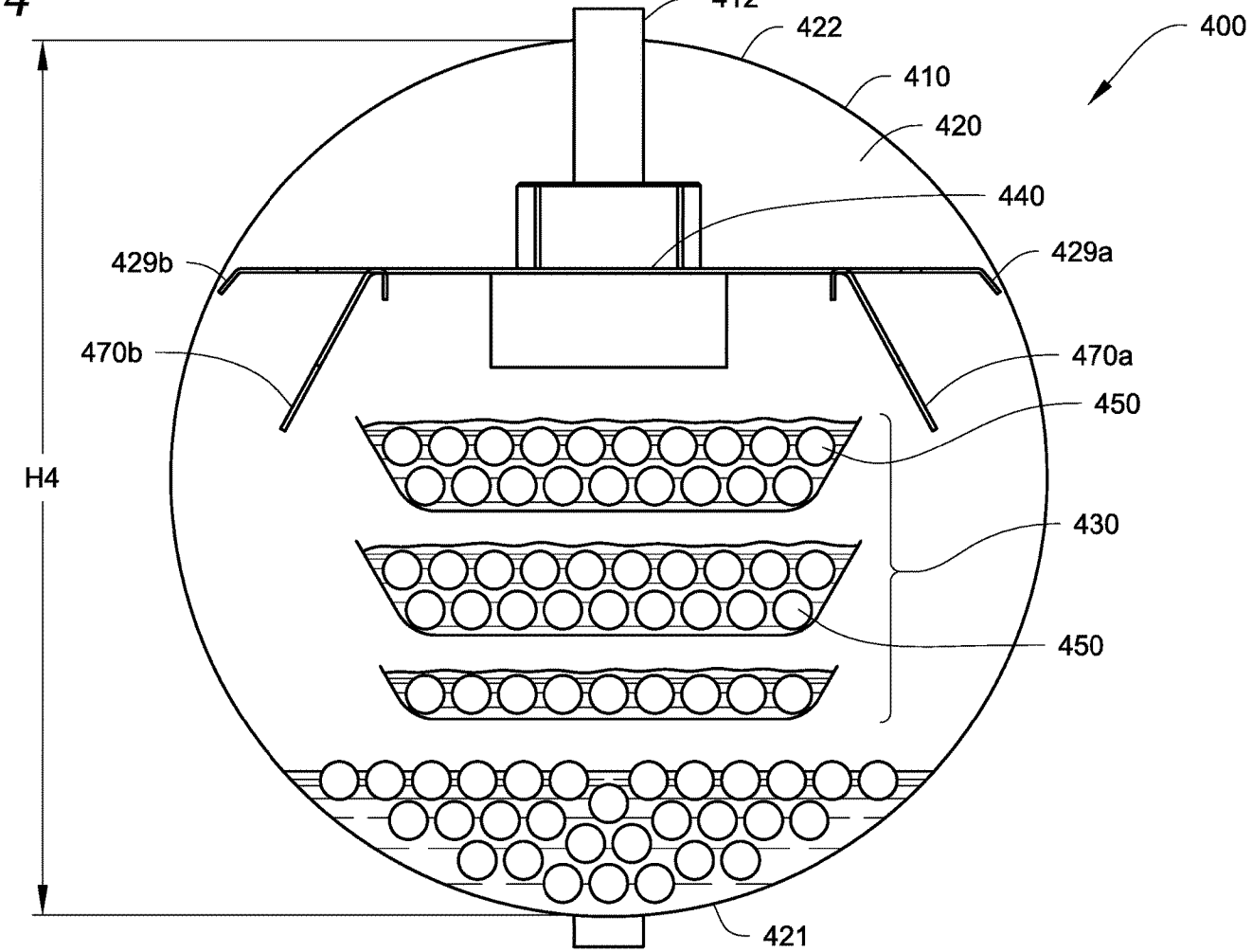
FIG. 4 illustrates an end view of another embodiment of an evaporator.

FIG. 4 provides additional features that an evaporator 400 can have. The evaporator 400 includes a shell 410 that defines a shell side 420. A top 422 of the shell 410 relative to a vertical direction that is defined by a height H4 of the shell 410 may include a refrigerant outlet 412, which is generally configured to allow refrigerant (generally refrigerant vapor) to be directed out of the shell side 420. Generally speaking, it is desirable that the refrigerant directed out of the shell side 420 through the refrigerant outlet 412 contains as little liquid refrigerant as possible.

In the evaporator 400, liquid refrigerant forms liquid pools that exchange heat with heat exchanger tubes 450 in a series of pans 430. The heat exchange between the refrigerant and a process fluid carried by the heat exchanger tubes 450 may cause liquid refrigerant splashing out of the series of pans 430, which may cause the liquid refrigerant being carried over into the refrigerant outlet 412.

To help reduce liquid refrigerant carry-over caused by, for example, liquid refrigerant splashing, the evaporator 400 can be equipped with, for example, a pair of guarding baffles 470*a* and 470*b*. The pair of guarding baffles 470*a* and 470*b* can be installed on a refrigerant distributor 440 that is positioned toward the top 422 of the shell 410. The guarding baffles 470*a* and 470*b* extend longitudinally along a length (not shown in FIG. 4, but see the length L in FIG. 2 for an example) of the shell 410.

In a vertical direction that is defined by a height H4 of the shell 410, the guarding baffles 470*a* and 470*b* diverge from each other in a direction from the top 422 to a bottom 421. The diverging guarding baffles 470*a* and 470*b* are generally configured to form an umbrella like structure to cover the series of pans 430, which may help reduce liquid refrigerant carry-over due to, for example, liquid refrigerant splashing in the series of pans 430.

The evaporator 400 can also include blocking baffles 429*a* and 429*b* that extend longitudinally to help generally block liquid refrigerant from getting into the refrigerant outlet 412. In the view of FIG. 4, the blocking baffles 429*a* and 429*b* are generally configured to substantially cover the shell side 420 that is below the blocking baffles 429*a* and 429*b* in the vertical direction. The blocking baffles 429*a* and 429*b* include apertures (not shown in FIG. 4, see the apertures 528 in FIG. 5 for an example) to allow refrigerant vapor to pass through, while generally blocking liquid refrigerant from passing through.

FIGS. 5A to 5G illustrate an evaporator 500 that can create longitudinal refrigerant streams in a shell 510 of the evaporator 500. (The shell 510 is omitted from FIG. 5A, and the heat exchanger tubes are omitted from FIGS. 5A to 5G for simplicity of the description. See FIG. 5B for the shell 510.) The embodiment as illustrated in FIGS. 5A to 5G also provides some other features that may help manage refrigerant and/or lubricant in the evaporator 500. It is noted that some of the features described herein may be used with embodiments as described, for example, in FIGS. 2A, 2B, 3 and 4. In some embodiments, the features as described herein may be used with an evaporator that is not described herein, for example, an evaporator that may not generally have longitudinal refrigerant streams in other embodiments (e.g. conventional falling film or flooded evaporators).

Figure 5A:
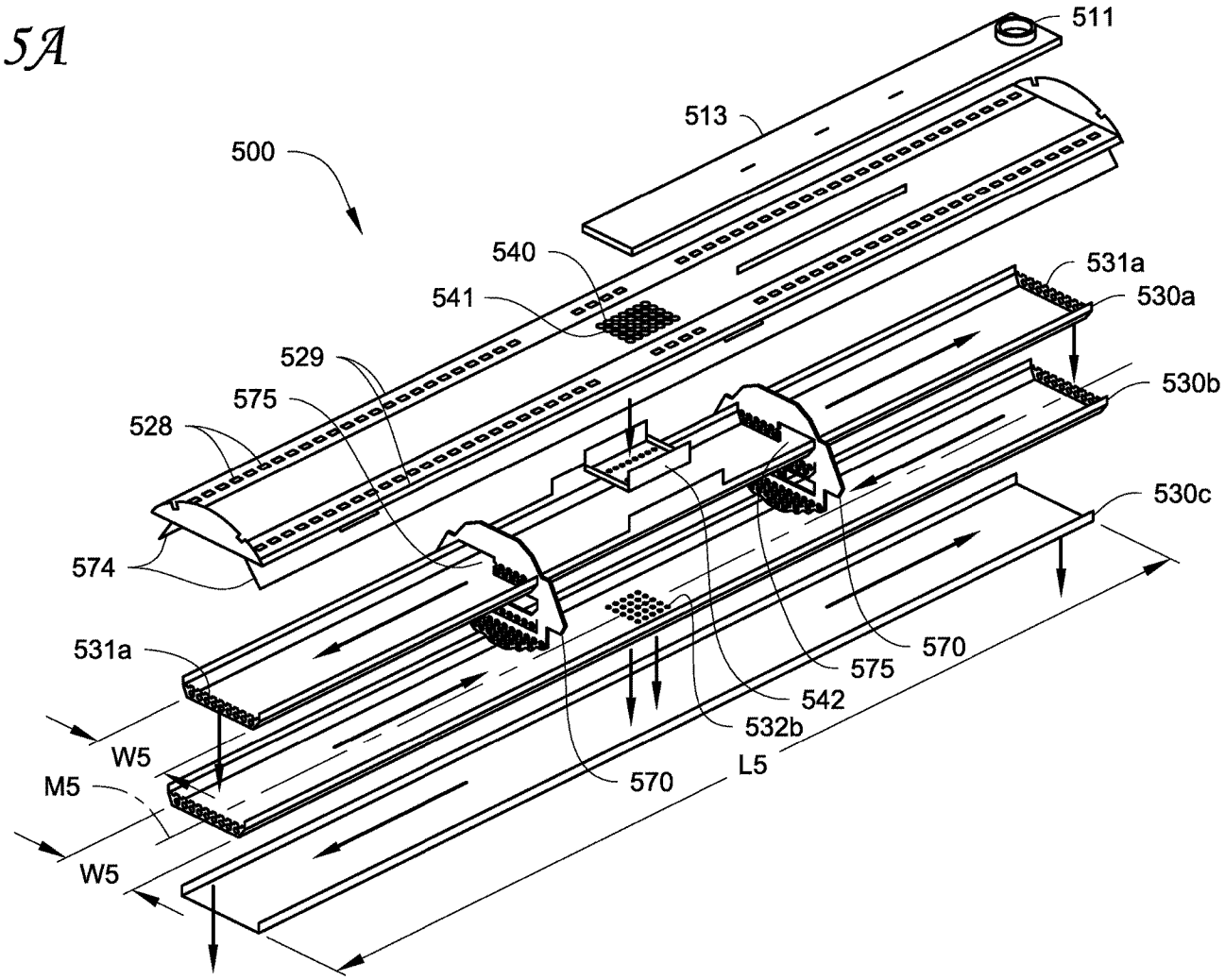
FIGS. 5A to 5G illustrate yet another embodiment of an evaporator.

FIG. 5A is an exploded view of components inside the shell 510 of the evaporator 500. The shell 500 and heat exchanger tubes are removed in FIG. 5A for simplicity. The embodiment as disclosed in FIG. 5A is generally configured to create longitudinal refrigerant streams that are similar to what is illustrated in FIG. 2A, as shown by arrows in FIG. 5A.

A refrigerant inlet 511 is configured to form a fluid communication with a refrigerant distributor 540 through, for example, a canoe 513. The refrigerant distributor 540 is configured to include one or more apertures 541 that allow the refrigerant to pass through. In the illustrated embodiment, the refrigerant distributor 540 is also configured to include an inlet baffle 542 that is configured to direct refrigerant to a top pan 530*a* to create a refrigerant stream in the pan 530*a*.

In the illustrated embodiment, the evaporator 500 includes three pans 530*a*, 530*b* and 530*c*. This is exemplary and not meant to be limiting. The evaporator 500 can be configured to include one or other numbers of pans.

Figure 5B:
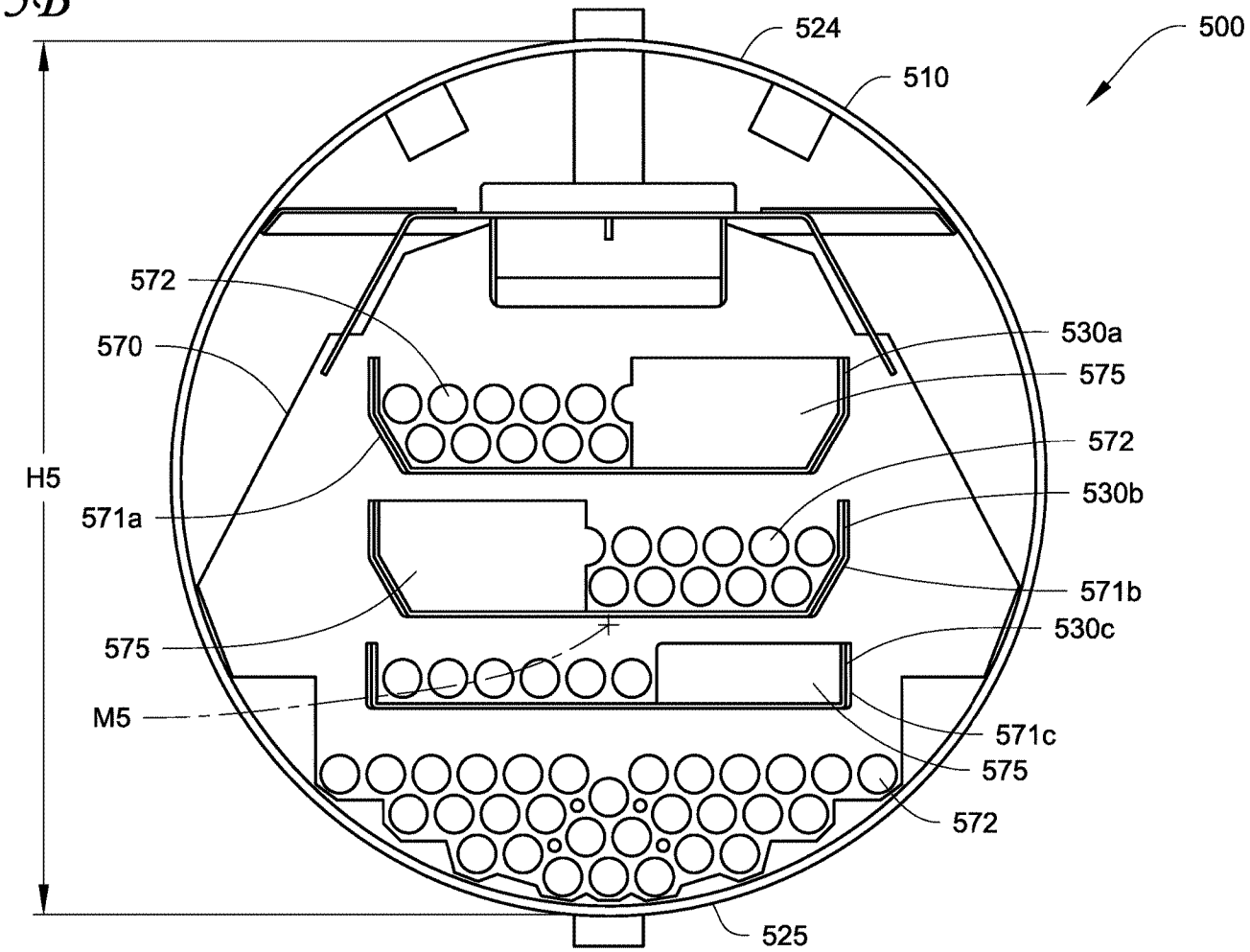

As illustrated in FIG. 5B, the pans 530*a*, 530*b* and 530*c* are arranged from a top 524 to a bottom 525 relative to a vertical direction defined by a height H5 of the shell 510. As illustrated in FIG. 5A, the pans 530*a*, 530*b* and 530*c* extend in a longitudinal direction that is defined by a length L5 of the evaporator 500. In the longitudinal direction, a length of the top pan 530*a* is generally shorter than the middle pan 530*b*, so that refrigerant can flow out of the top pan 530*a* and flows down to the middle pan 530*b* out of ends 531*a* of the top pan 530*a*.

The middle pan 530*b* includes a drainage 532*b* that can be configured to allow refrigerant to flow out of the middle pan 530*b* and be directed to the bottom pan 530*c* through the drainage 532*b*.

It is noted that the shape of the each of the pans 530*a*, 530*b* and 530*c* can be different. The shape of the pans 530*a*, 530*b* and 530*c* can be configured based on, for example, number of heat exchanger tubes to be included in the pans 530*a*, 530*b* and 530*c*. In the illustrated embodiments, the number of rows of heat exchanger tubes is two rows in pans 530*a* and 530*b*, while the bottom pan 530*c* has one row of heat exchanger tubes.

Figure 5C:
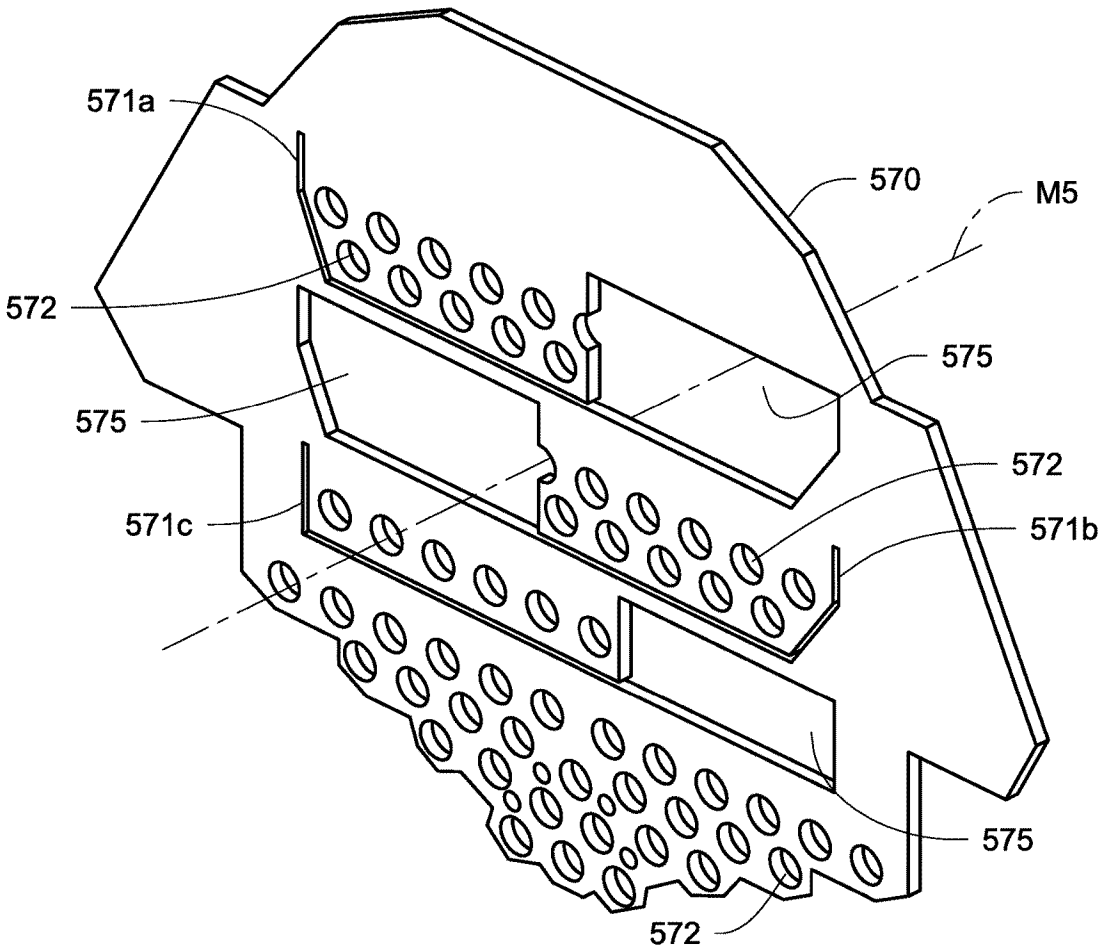

The evaporator 500 also include one or more tube sheets 570 to support the pans 530*a*, 530*b* and 530*c*, as well as heat exchanger tubes. FIGS. 5B and 5C illustrate front and perspective views of the tube sheet 570 respectively. The tube sheet 570 includes through slots 571*a*, 571*b* and 571*c* shaped to allow the pans 530*a*, 530*b* and 530*c* to pass through. The tube sheet 570 also includes through apertures 572 configured to receive heat exchanger tubes. The through apertures 572 are generally configured to accept one heat exchanger tube for each of the through apertures 572.

To facilitate creating liquid refrigerant streams, the tube sheet 570 includes one or more open areas 575 that are configured to allow refrigerant to flow relatively freely through the tube sheet 570. As illustrated in FIG. 5A, when two or more tube sheets 570 are used in the evaporator 500, positions of the open areas 575 relative to a middle line M5 of the pans, such as pan 530*b*, are alternatively arranged in a width direction defined by a width W5. The open areas 575 may allow the refrigerant streams to flow through the tube sheet 570 relatively easily. The heat exchanger tubes can be supported by apertures 572 on one of the tube sheets 570 to provide structural support.

Figure 5D:
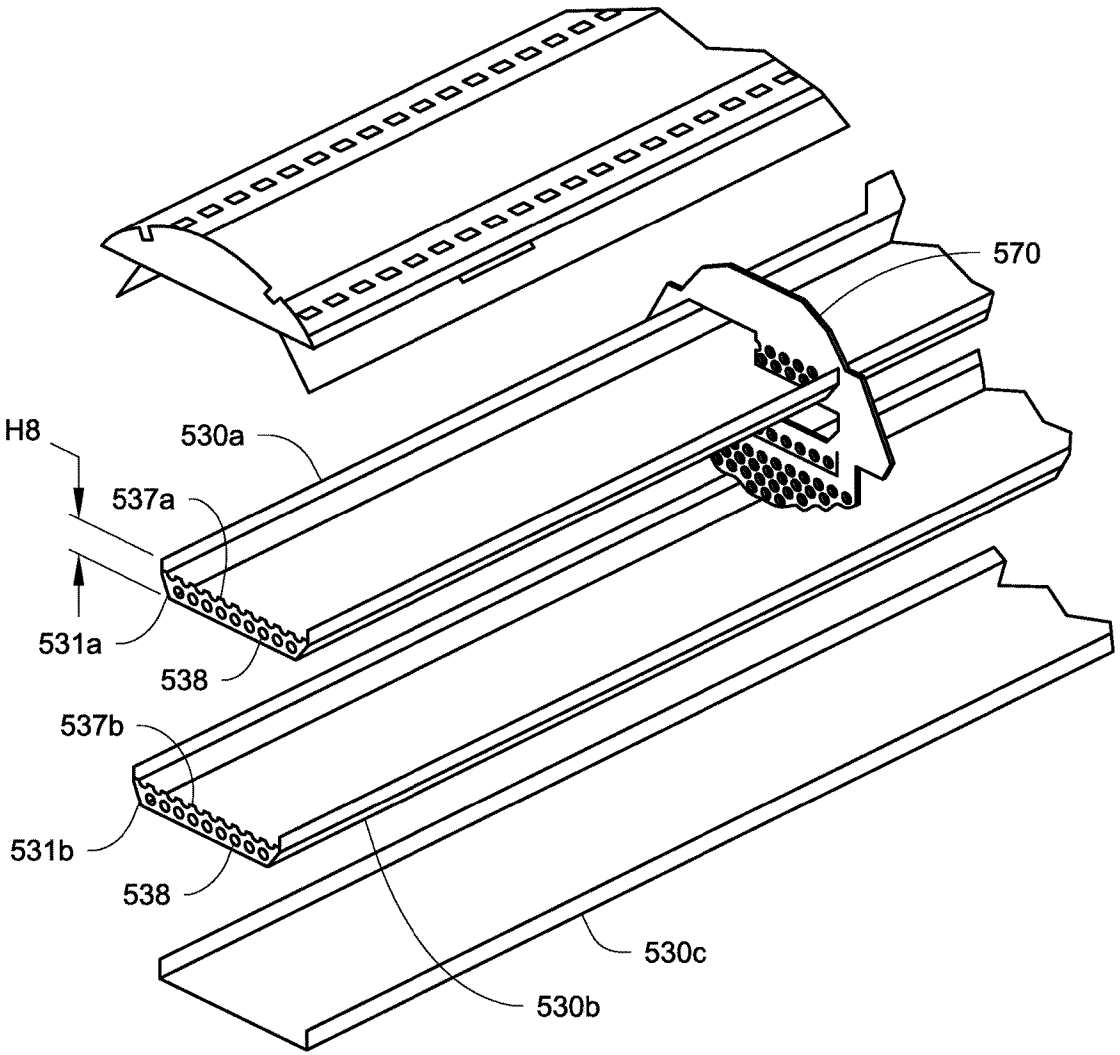

Referring back to FIG. 2B, each of the pans 230*a*, 230*b* and 230*c* is configured to form liquid pools in the pan spaces 239*a*, 239*b* and 239*c* respectively to exchange heat with a process fluid carried in the heat exchanger tubes 250. Referring to FIG. 5D, to help maintain a proper liquid refrigerant pool level in the pans 530*a*, 530*b* and/or 530*c*, the ends of the pans, such as the end 531*a* and the end 531*b*, can be configured to have a sealing member 537*a*, 537*b* respectively. The sealing members 537*a* and 537*b* can be configured to have sealing apertures 538 to accept heat exchanger tubes and the sealing apertures 538 can be configured to seal around the heat exchanger tubes when the heat exchanger tubes passes through the sealing apertures 538. Liquid refrigerant can generally flow out of the pans, such as the pan 530*a*, when the level of the liquid refrigerant pool is higher than, for example, a height H8 of the sealing member 537*a*. Therefore, a proper liquid refrigerant pool level in the pans, such as the pan 530*a*, can be maintained.

It is noted that the sealing member 537*a* and 537*b* may not be necessary when a desired refrigerant pool level can be reached/maintained without using the sealing member 537*a* and 537*b*. For example, in the illustrated embodiment, the bottom pan 530*c* is configured to contain just one row of heat exchanger tubes. The sealing member, such as sealing members 537*a* and 537*b*, may not be needed to achieve a desired refrigerant level in the pan 530*c* to exchange heat with the row of heat exchanger tubes.

Figure 5E:
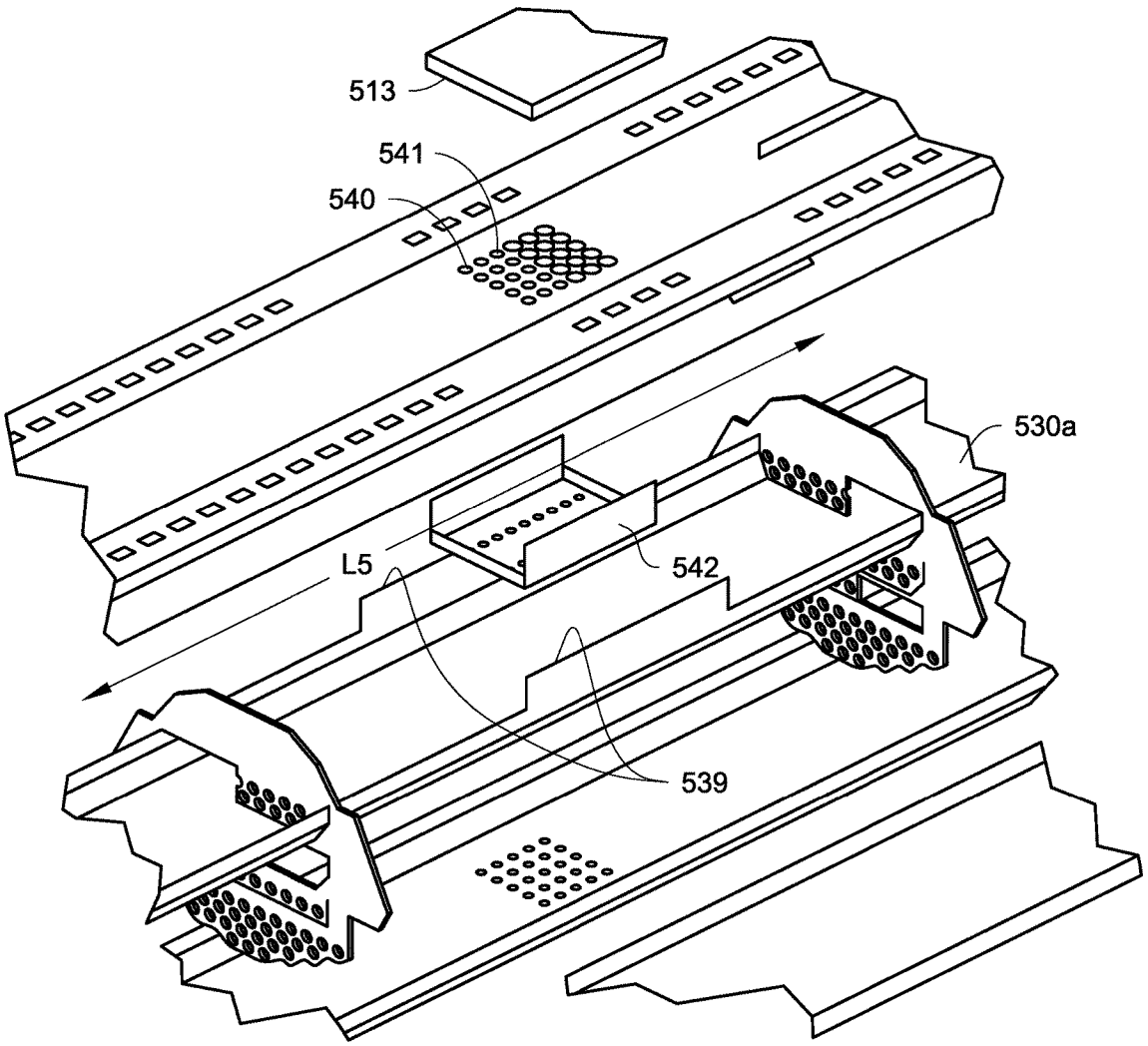

As illustrated in FIGS. 5A and 5E, the evaporator 500 is configured to direct liquid refrigerant into the top pan 530*a* in a middle region of the top pan 530*a*. A velocity (or volume) of the liquid refrigerant, when directed to the top pan 530*a* through the inlet baffle 542, may be relatively high. Consequently, when the refrigerant is directed to the top pan 530*a*, some of the refrigerant may splash. To help prevent the refrigerant from splashing out of the middle region of the top 530*a*, the middle region of the top pan 530*a* includes raised edges 539 extending in a longitudinal direction to help block the refrigerant splash. The raised edges 539 are generally positioned to flank the inlet baffle 542.

In some embodiments, such as the embodiments as illustrated in FIGS. 2A, 2B and 3, and the evaporator 500 as illustrated in FIG. 5A, the refrigerant outlet (not shown in FIG. 5A) can be positioned at a top of the shell. To help prevent/reduce liquid refrigerant carry-over to the refrigerant outlet, the evaporator may also include structures to block liquid refrigerant, such as the blocking baffles 429*a* and 429*b* and/or the guarding baffles 470*a* and 470*b* as shown in FIG. 4, for example.

As illustrated in FIG. 5A, the evaporator 500 includes one or more blocking baffles 529 and guarding baffles 574 to help prevent/reduce liquid refrigerant carrying-over into the refrigerant outlet. The blocking baffles 529 include one or more apertures 528 to generally allow refrigerant vapor to pass through, while generally blocking liquid refrigerant.

The guarding baffles 574 are generally configured to form an umbrella like structure to cover the pans 530*a*, 530*b* and/or 530*c* in the vertical direction, so as to prevent/reduce liquid refrigerant carry-over due to, for example, refrigerant splashing, in the pans 530*a*, 530*b* and/or 530*c*.

Figure 5F:
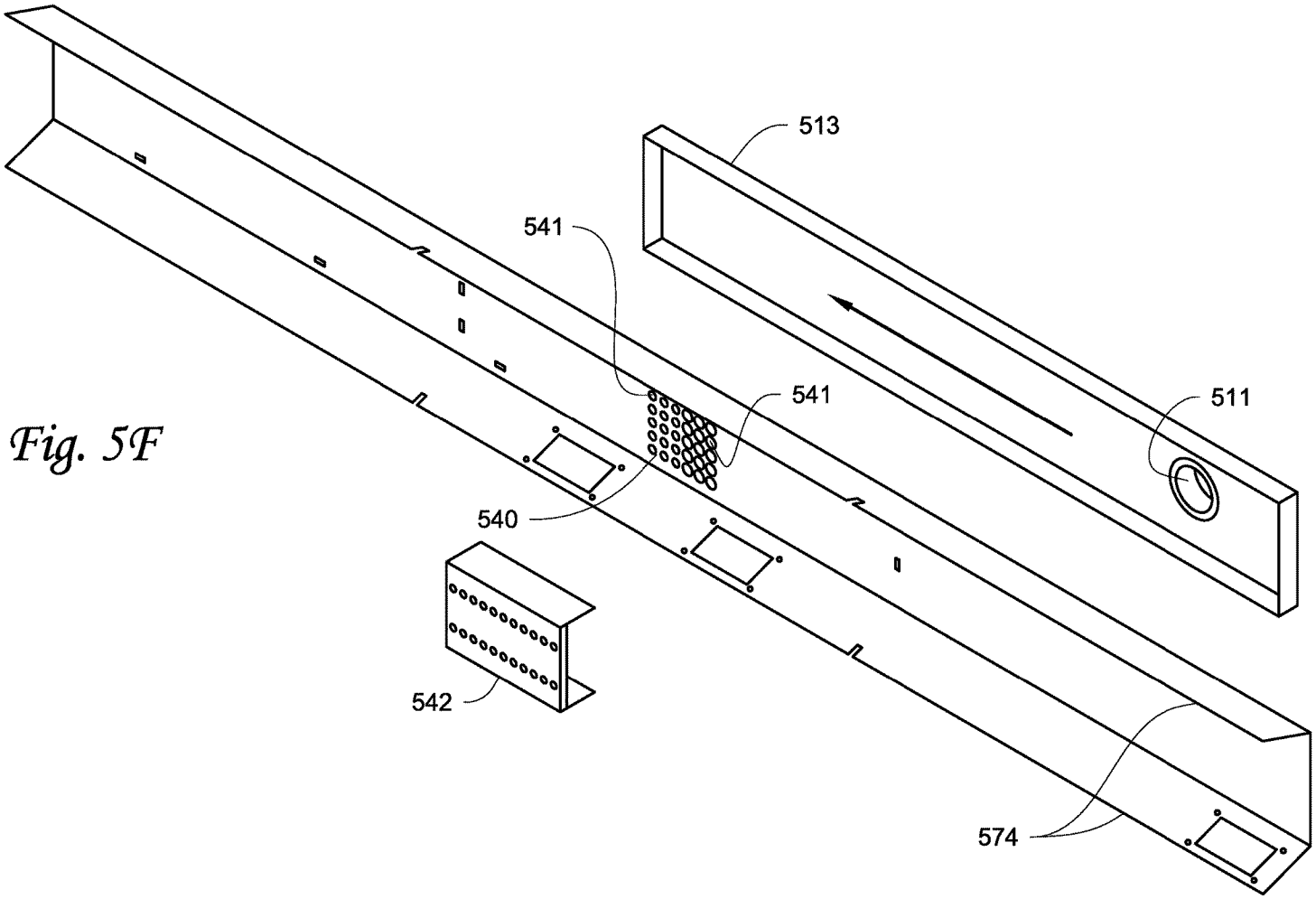

Referring to FIG. 5F, the refrigerant distributor 540 is described in more detail. The refrigerant distributor 540 is generally configured to direct refrigerant into, for example, the middle region of the top pan 530*a*. The refrigerant distributor 540 may include one or more distribution apertures 541. When the refrigerant distributor 540 includes a plurality of distribution apertures 541, a size (or a diameter) of each of the aperture may not be the same.

In the illustrated embodiment and the orientation as shown, the refrigerant flow is directed toward the refrigerant distributor 540 from the right side through the refrigerant inlet 511. As illustrated, the apertures 541 toward the left side in the orientation shown may have a higher refrigerant velocity than the apertures 541 toward the right side. To help evenly distribute the refrigerant, the size of the apertures 541 toward the left side in some embodiments may be smaller than the apertures 541 toward the right side.

Figure 5G:
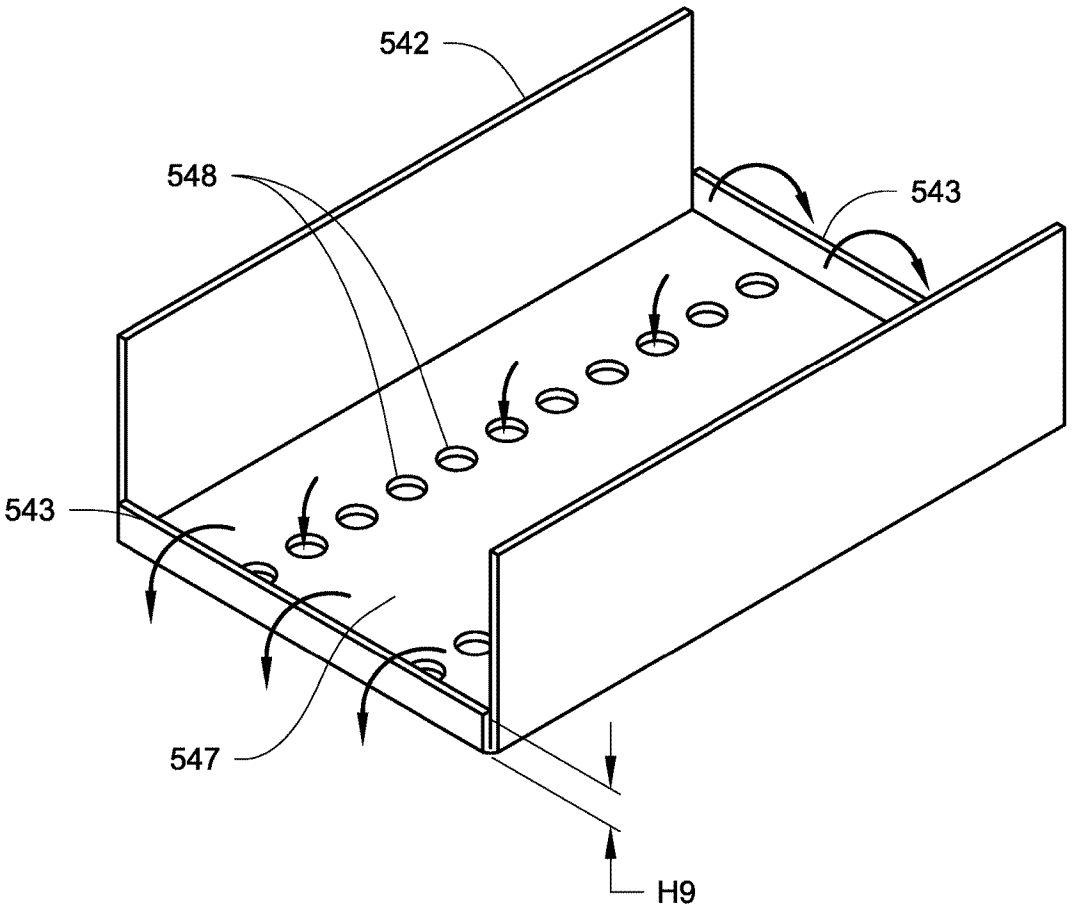

The high velocity of the refrigerant may also damage the heat exchanger tubes in the top pan 530*a*. The inlet baffle 542 may help reduce the velocity of the refrigerant. FIG. 5G is an enlarged view of the inlet baffle 542. The inlet baffle 542 has a bottom 547 that includes one or more apertures 548 to allow refrigerant to pass through. In the longitudinal direction, the inlet baffle 542 also has two overflow guards 543 that extend upward from the bottom 547. A height H9 of the overflow guard 543 can be changed based on, for example, design requirements or the requirements to reduce the velocity of the refrigerant. Generally, the higher the height H9 is, the less refrigerant flowing over the overflow guards 543. By configuring, for example, a number of apertures 548, a size of the aperture 548 and/or the height H9 of the overflow guards 543, a distribution of the refrigerant flowing through the apertures 548 and the refrigerant flowing over the overflow guards 543 may be controlled and the velocity of the refrigerant after flowing through the inlet baffle 542 may be regulated. In one particular embodiment, for example, the amount of refrigerant overflowing through the overflow guards 543 is about 30-40% of the total refrigerant directed into the inlet baffle 542. It is to be noted that the relative amount of the refrigerant overflowing is exemplary. The inlet baffle 542 is generally designed to reduce the velocity of the refrigerant to prevent the heat exchanger tubes from being damaged by the refrigerant.

The embodiments as disclosed herein can help reduce the total number of heat exchanger tubes needed for the evaporator compared to a conventional falling film or flooded evaporator. Therefore, the embodiments as disclosed herein may help reduce the cost of making the evaporator. The embodiments as disclosed herein may also help oil return from the evaporator. The embodiments as disclosed herein can help to reduce performance variation and increase the predictability and reliability of the performance. Compared to a conventional flooded evaporator, the refrigerant charge to the evaporator can also be reduced.

It is noted that any aspects 1-7 can be combined with any aspects 8-20. Any aspects 8-12 can be combined with any aspects 13-20. Aspect 13 can be combined with any aspects 14-20.

1. A method of managing refrigerant in an evaporator, comprising:

directing liquid refrigerant into a shell side of the evaporator;

collecting the liquid refrigerant and directing the liquid refrigerant toward a longitudinal direction of the evaporator to form a first longitudinal refrigerant stream; and forming a refrigerant pool to exchange heat with a heat exchanger tube of the evaporator.

2. The method of aspect 1, wherein directing liquid refrigerant into a shell side of the evaporator is performed around a top of the evaporator.

3. The method of aspects 1-2, wherein directing the liquid refrigerant into the shell side of the evaporator around a top of the evaporator is performed around a middle portion of the top of the evaporator.

4. The method of aspects 1-3, wherein directing the liquid refrigerant toward a longitudinal direction of the evaporator to form a first longitudinal refrigerant stream includes directing the liquid refrigerant toward two ends of the evaporator to form a bidirectional longitudinal refrigerant stream toward the two ends of the evaporator.

5. The method of aspects 1-2, wherein directing the liquid refrigerant into the shell side of the evaporator around a top of the evaporator is performed around a first end of the evaporator.

6. The method of aspects 1-5, wherein directing the liquid refrigerant toward a longitudinal direction of the evaporator to form a longitudinal refrigerant stream includes directing the liquid refrigerant toward a second end of the evaporator to form a longitudinal refrigerant stream from the first end toward the second end of the evaporator.

7. The method of aspect 1, further comprising:

collecting refrigerant from the first refrigerant stream; and directing the collected refrigerant from the first refrigerant stream toward an opposite direction in the longitudinal direction.

8. An shell and tube evaporator, comprising:

a shell side;

an inlet configured to direct refrigerant into the shell side;

a first pan extending in a longitudinal direction of the evaporator in the shell side, the first pan configured to collect the refrigerant in the first pan to form a first refrigerant pool, and direct the refrigerant to flow along the first pan; and a first plurality of longitudinally extended heat exchanger tubes positioned above a bottom of the first pan;

wherein the first refrigerant pool is configured to exchange heat with at least one of the first plurality of longitudinally extended heat exchanger tubes.

9. The shell and tube evaporator of aspect 8, further comprising:

a second pan extending in the longitudinal direction, the second pan positioned below the first pan in a vertical direction of the evaporator;

wherein the second pan is configured to collect the refrigerant flowing out of the first pan to form a second refrigerant pool, and direct the refrigerant to flow along the second pan.

10. The shell and tube evaporator of aspects 8-9, further comprising:

a second plurality of longitudinally extended heat exchanger tubes positioned above a bottom of the second pan; wherein the second refrigerant pool is configured to exchange heat with at least one of the second plurality of longitudinally extended heat exchanger tubes.

11. The shell and tube evaporator of aspect 8, wherein the inlet is positioned about a first end of the evaporator, wherein the inlet is configured to direct refrigerant into the first pan at a position that is about the first end of the evaporator.

12. The shell and tube evaporator of aspect 8, wherein the inlet is positioned about a middle portion of the evaporator, wherein the inlet is configured to direct refrigerant into the first pan at a middle position of the pan.

13. A shell and tube evaporator, comprising:

a shell side;

an inlet configured to direct refrigerant into the shell side;

a first pan extending in a longitudinal direction of the evaporator, the first pan defining a pan space;

a first plurality of longitudinally extended heat exchanger tubes positioned in the pan space;

wherein the pan space is configured to collect the refrigerant directed by the inlet and direct the refrigerant to flow along the first pan in the pan space; and at least one of the first plurality of longitudinally extended heat exchanger tubes is configured to exchange heat with the refrigerant collected in the pan space.

14. A method of managing lubricant in an evaporator, comprising:

directing a refrigerant/lubricant mixture into a shell side of the evaporator;

collecting the refrigerant/lubricant mixture and directing the refrigerant/lubricant mixture toward a longitudinal direction of the evaporator to form a first longitudinal refrigerant/lubricant mixture stream;

forming a refrigerant/lubricant mixture pool to exchange heat with a heat exchanger tube of the evaporator so as to vaporize a refrigerant content in the refrigerant/lubricant mixture as the refrigerant/lubricant mixture flowing in the first longitudinal refrigerant/lubricant mixture stream; and collecting the refrigerant/lubricant mixture at a bottom of the evaporator.

15. The method of aspect 14, wherein directing the refrigerant/lubricant mixture into a shell side of the evaporator is performed around a top of the evaporator.

16. The method of aspects 14-15, wherein directing the refrigerant/lubricant mixture into the shell side of the evaporator around a top of the evaporator is performed around a middle portion of the top of the evaporator.

17. The method of aspects 14-16, wherein directing the refrigerant/lubricant mixture toward a longitudinal direction of the evaporator to form a first longitudinal refrigerant/lubricant mixture stream includes directing the refrigerant/lubricant mixture toward two ends of the evaporator to form bidirectional longitudinal refrigerant/lubricant mixture stream toward the two ends of the evaporator.

18. The method of aspects 14-15, wherein directing the refrigerant/lubricant mixture into the shell side of the evaporator around a top of the evaporator is performed around a first end of the evaporator.

19. The method of aspects 14-18, wherein directing the refrigerant/lubricant mixture toward a longitudinal direction of the evaporator to form a longitudinal refrigerant stream includes directing the refrigerant/lubricant mixture toward a second end of the evaporator to form a longitudinal refrigerant/lubricant mixture stream from the first end toward the second end of the evaporator.

20. The method of aspects 14, further comprising:

collecting refrigerant/lubricant mixture from the first refrigerant stream; and directing the collected refrigerant/lubricant mixture from the first refrigerant/lubricant mixture stream toward an opposite direction in the longitudinal direction.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

What claimed is:

1. An shell and tube evaporator, comprising:

a shell side;

an inlet configured to direct refrigerant into the shell side;

a first pan extending in a longitudinal direction of the evaporator in the shell side, the first pan configured to collect the refrigerant in the first pan to form a first refrigerant pool, and direct the refrigerant to flow along the first pan in the longitudinal direction of the evaporator to a first end and to a second end of the first pan; wherein the first end and second end are at opposite ends of the first pan; and a first plurality of longitudinally extended heat exchanger tubes positioned above a bottom of the first pan; and a second pan extending in the longitudinal direction of the evaporator, the second pan positioned below the first pan in a vertical direction of the evaporator and wherein the second pan extends beyond the first end and the second end of the first pan in the longitudinal direction of the evaporator;

wherein the first refrigerant pool is configured to exchange heat with at least one of the first plurality of longitudinally extended heat exchanger tubes, and the second pan is configured to collect the refrigerant flowing out of the first end and the second end of the first pan to form a second refrigerant pool, and direct the refrigerant to flow along the second pan in the longitudinal direction.

2. The shell and tube evaporator of claim 1, further comprising:

a second plurality of longitudinally extended heat exchanger tubes positioned above a bottom of the second pan; wherein the second refrigerant pool is configured to exchange heat with at least one of the second plurality of longitudinally extended heat exchanger tubes.

3. The shell and tube evaporator of claim 1, wherein the inlet is positioned about a middle portion of the evaporator, wherein the inlet is configured to direct refrigerant into the first pan at a middle portion of the pan.

4. The shell and tube evaporator of claim 1, wherein:

the first pan defines a pan space, the first plurality of longitudinally extended heat exchanger tubes are positioned in the pan space, the pan space is configured to collect the refrigerant directed by the inlet and direct the refrigerant to flow along the first pan in the pan space, and at least one of the first plurality of longitudinally extended heat exchanger tubes is configured to exchange heat with the refrigerant collected in the pan space.

5. The shell and tube evaporator of claim 1, further comprising a sealing member at one of the first end of the first pan or the second end of the first pan, wherein the sealing member is configured to form a seal around at least one of the first plurality of longitudinally extended heat exchanger tubes, and when the level of the first refrigerant pool exceeds a height of the sealing member, the refrigerant flows out of the first pan and into the second pan.

* * * * *